United States Patent [19]

Mouratoglu et al.

[11] Patent Number: 4,786,419

[45] Date of Patent: Nov. 22, 1988

[54] METHOD AND DEVICE FOR IMPROVING THE REOXYGENATION OF WATER IN LINE WITH BARRAGES

[75] Inventors: Pâris Mouratoglu, Neuilly sur Seine; Jean-Claude Borel, Nanterre, both of France

[73] Assignees: Energies France; GTM Entrepose, both of France

[21] Appl. No.: 62,996

[22] Filed: Jun. 17, 1987

[30] Foreign Application Priority Data

Jun. 19, 1986 [FR] France ..... 86 08861

[51] Int. Cl.[4] ..... B01F 3/04

[52] U.S. Cl. ..... 210/747; 210/758; 210/154; 210/170; 210/926

[58] Field of Search ..... 210/521, 926, 620, 626, 210/627, 758, 154, 170, 198.1, 747

[56] References Cited

U.S. PATENT DOCUMENTS 4,324,655 4/1982 Muskat ..... 210/926

4,400,274 8/1983 Protos ..... 210/521

*Primary Examiner*—Frank Sever

*Attorney, Agent, or Firm*—William A. Drucker

[57] ABSTRACT

A method and device are provided for improving the reoxygenation of water in line with dams. At the crown of the dam a plurality of studs are disposed which form a comb and cause thorough division of the overflowing sheet of water. This sheet of water undergoes a veritable disintegration which increases the air-water interface and causes an increase in the oxygenation of the overflowing flow.

2 Claims, 2 Drawing Sheets

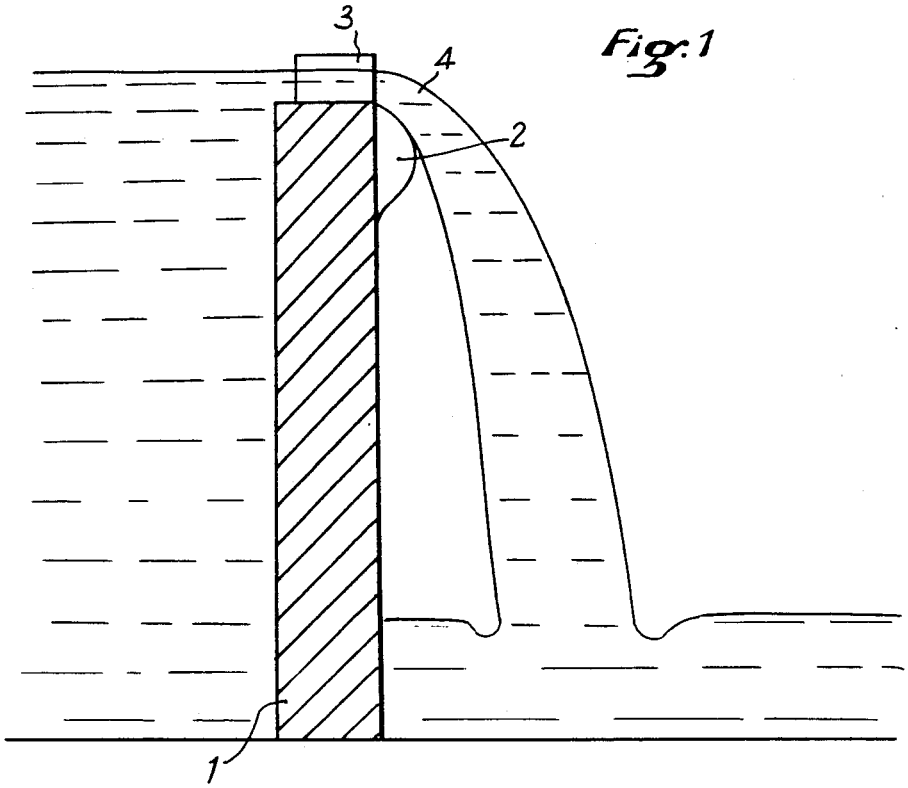
Fig: 1
Fig: 2
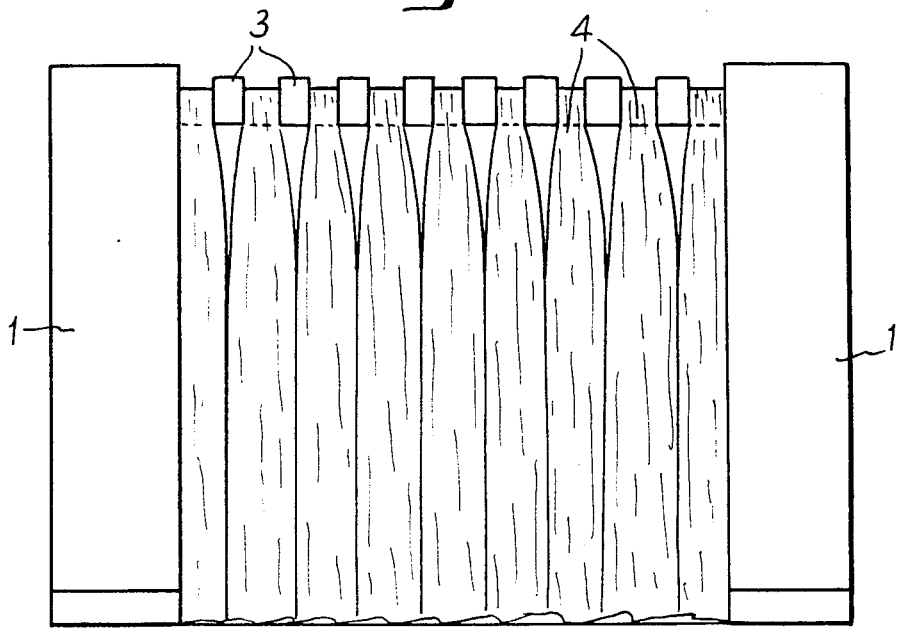

METHOD AND DEVICE FOR IMPROVING THE REOXYGENATION OF WATER IN LINE WITH BARRAGES

BACKGROUND OF THE INVENTION

The invention relates to a method for improving the efficiency of the reoxygenation of water in line with a barrage, or dam, as well as a device designed for putting this method into practice.

It is known that dissolved oxygen forms an important factor in the quality of the water of a river, for it promotes aquatic life and the biodegradation of organic waste. Barrages, which create a certain difference in level, contribute to reoxygenating the flow in proportions which are all the higher the lower the oxygen content upstream. This reoxygenation is achieved by means of an overflow, formed by the water fall from the crown of the dam to the downstream water level. This overflow profits in fact from a certain oxygenation by diffusion, during the fall, through the air-water interface. In addition, it brings with it air bubbles which provide oxygenation of the water in depth.

The aim of the present invention is to improve the efficiency of reoxygenation of the water in line with a dam by an overflow and for this it proposes the use of a method which, while being simple to use and inexpensive, provides significant gains at the reoxygenation level.

SUMMARY OF THE INVENTION

The method of the invention consists in causing disintegration of the jet overflowing from the dam so as to make the air-water interface maximum during the fall, thus increasing on the one hand the oxygenation of the overflow by diffusion and, on the other, the amount of entrained air bubbles.

For putting this method into practice, the invention proposes disposing at the crown of the dam a plurality of projecting elements against which the overflowing water sheet is divided then disintegrated.

In the past, some small studs were placed above the valves of certain dams, but they were not for the same purpose. Their purpose was solely to ensure an equal pressure between the air mass situated between the valve and the sheet of water on the one hand and the ambient air on the other, so as to prevent vibration of the valve. The present invention, by using a large number of projecting elements forming a veritable comb, has another purpose which is to obtain a real disintegration of the sheet of water so as to increase the air-water contact area;

The invention applies not only for an integral overflow but also in the case where part of the flow transits in an under flow through bottom valves (this latter flow being called "mixed flow".).

BRIEF DESCRIPTION OF THE DRAWINGS

For a better understanding of the device of the invention, a preferred embodiment thereof will be described hereafter by way of example without any limitative character and with reference to the accompanying schematical drawings in which:

FIG. 1 is a profile view of a dam equipped at its upper part with a device of the invention;

FIG. 2 is a front view corresponding to FIG. 1; and

DESCRIPTION OF THE PREFERRED EMBODIMENT

Figure 3:
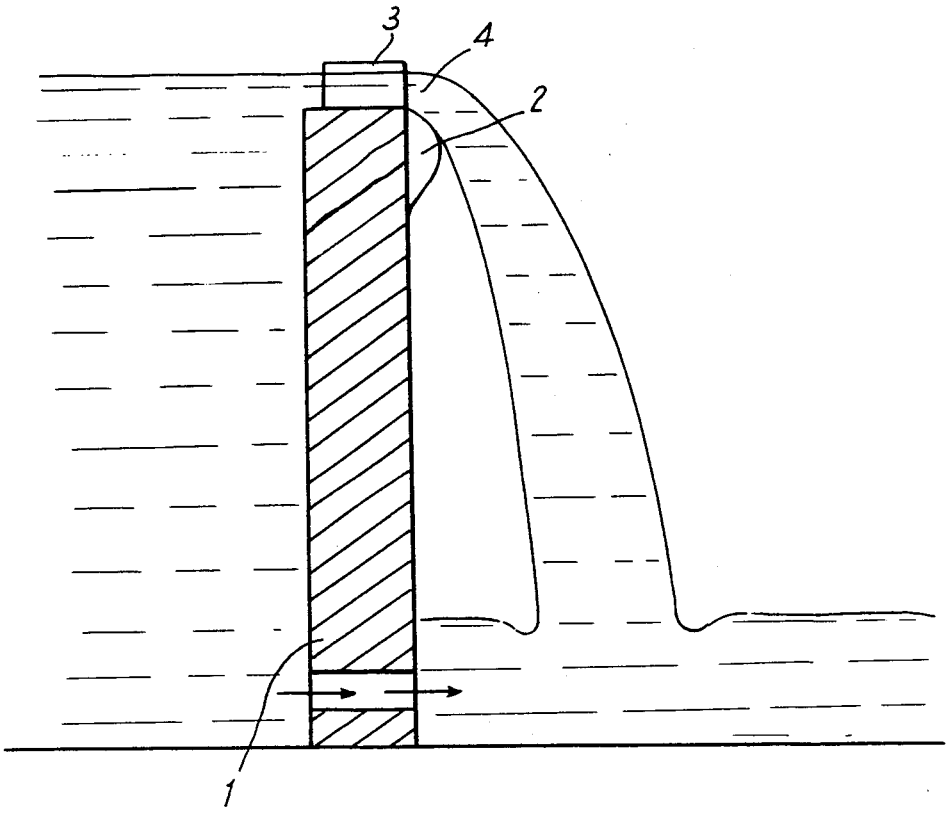
FIG. 3 is a profile view of a dam equipped at its upper part with a device of the invention, in the case of a mixed flow.

In the drawings a dam has been shown at 1 equipped at its upper end with valves 2. In accordance with the invention, valves 2 have, at their crown, a plurality of studs 3 (8 in number in the example shown). Studs 3 form a veritable comb and because of their number provide a thorough division of the overflowing sheet 4 which provides a veritable disintegration thereof by increasing the air-water interface. Numerous measurements have shown that this increase of the air-water interface during the fall causes an increase, on the one hand, of the oxygenation of the overflow by diffusion and, on the other hand, of the amount of entrained air bubbles.

It will be understood that the above description has been given solely by way of example and that constructional additions or modifications could be made thereto without departing from the scope or spirit of the invention defined by the following claims.

What is claimed is:

1. A method for improving reoxygenation of water in line with a dam, comprising the steps of:

(a) providing a dam, (b) causing a sheet of water to travel over the crown of said dam, and (c) substantially increasing the penetration of atmospheric oxygen into the sheet of water by providing elements at the crown of said dam spaced sufficient to cause disintegration of said sheet of water.

2. A device for improving reoxygenation of water in line with a dam, comprising:

(a) a dam, and (b) means at the crown of said dam spaced sufficient for substantially increasing the penetration of atmospheric oxygen into a sheet of water passing over the crown of said dam, said means comprising:

(c) a plurality of projecting elements disposed at the crown of said dam for causing division of a sheet of water flowing over the crown of said dam.

* * * * *